United States Patent [19]

Mima

[11] 4,446,687

[45] May 8, 1984

[54] PNEUMATIC YARN SPLICING APPARATUS FOR SPLICING CORE SPUN YARNS

[75] Inventor: Hiroshi Mima, Kyoto, Japan

[73] Assignee: Murata Kikai Kabushiki Kaisha, Kyoto, Japan

[21] Appl. No.: 446,486

[22] Filed: Dec. 2, 1982

[30] Foreign Application Priority Data

Dec. 2, 1981 [JP] Japan ..... 56-194790

[51] Int. Cl.[3] ..... D01H 15/00

[52] U.S. Cl. ..... 57/22; 57/261

[58] Field of Search ..... 57/22, 261, 262, 263, 57/2.3

[56] References Cited

U.S. PATENT DOCUMENTS

| | | | |
|---|---|---|---|
| 4,263,775 | 4/1981 | Mima | 57/261 X |
| 4,322,943 | 4/1982 | Rohner et al. | 57/261 |
| 4,408,442 | 10/1983 | Rohner | 57/22 |

*Primary Examiner*—Donald Watkins

*Attorney, Agent, or Firm*—Spensley, Horn, Jubas & Lubitz

[57] ABSTRACT

A pneumatic yarn splicing apparatus for splicing spun yarns including two nozzle pipes for untwisting and attracting yarn ends to be spliced and a yarn splicing member having a yarn splicing hole which is disposed between the nozzle pipes. The nozzle pipes have opening areas reduced with respect to the diameter of the nozzle pipe to increase the speed of flow of the suction stream of air.

4 Claims, 14 Drawing Figures

PNEUMATIC YARN SPLICING APPARATUS FOR SPLICING CORE SPUN YARNS

BACKGROUND OF THE INVENTION

The present invention relates to a pneumatic yarn splicing apparatus for splicing spun yarns.

Pneumatic yarn splicing processes are advantageous over a prior process of knotting yarns together in that since there is no knot at the spliced ends, the spliced yarns present reduced resistance to their movement through yarn guides and are less liable to be broken in subsequent steps, and the spliced ends cannot easily be found in final textile products.

Various pneumatic yarn splicing devices have been proposed so far. According to Japanese Patent Publication No. 56-47108, yarn ends are untwisted in nozzle pipes prior to yarn splicing, and the yarns are spliced under a stream of compressed air while they are arranged in the nozzle pipes with distal ends attracted by streams of suction air with the other ends fixedly held. Such a yarn splicing process produces sightly spliced yarn ends which are of an increased strength and thus practical in use. With the disclosed process, the yarn ends passing through a yarn splicing hole and untwisted by streams of air in the nozzle pipes are disposed one on each side of the yarn splicing hole. The yarn ends thus untwisted are drawn out by levers, and the yarns are spliced while the distal ends of the yarn remain adjacent to openings of the nozzle pipes by the action of the suction air streams. As described in the above publication, attracting and retaining the yarn distal ends with the suction air streams is more advantageous than means for mechanically holding yarn ends in that the yarns as spliced remain flexible, and the yarn ends become sufficiently entangled with each other leaving no angular yarn ends. Since yarn splicing due to compressed streams of air takes place around the yarn splicing hole, the openings of the nozzle pipes are located as closely to the yarn splicing hole as possible because the yarn distal ends sufficiently spaced from the yarn splicing hole would not be preferable. The yarn distal ends are attracted and held by the suction air stream in the vicinity of the openings of the nozzle pipes with the yarn ends remaining slightly within the nozzle pipes.

The yarn ends are pulled out by the levers to bring the yarn ends sufficiently attracted and untwisted in the nozzle pipes to the foregoing condition.

Where core spun yarns having resilient cores of polyurethane are employed, the yarn ends as they are drawn out become abruptly displaced under their own resiliency by the action of the suction air stream in the vicinity of the nozzle pipe openings, with the result that the yarn ends tend to get spliced within the yarn splicing hole while they are sagged.

SUMMARY OF THE INVENTION

It is an object of the present invention to provide a yarn splicing apparatus suitable for splicing core spun yarns in which the suction stream of air in the nozzle pipes are intensified to increase the force with which yarn ends are sucked and attracted into the nozzle pipes.

The present invention resides in that nozzle pipes have opening areas reduced with respect to the diameter thereof to increase the speed of flow of the suction streams of air, instead of intensifying streams of air within the nozzle pipes which would affect the untwisting of the yarn ends.

DETAILED DESCRIPTION OF THE INVENTION

The present invention will now be described with reference to an illustrated embodiment.

Figure 1:
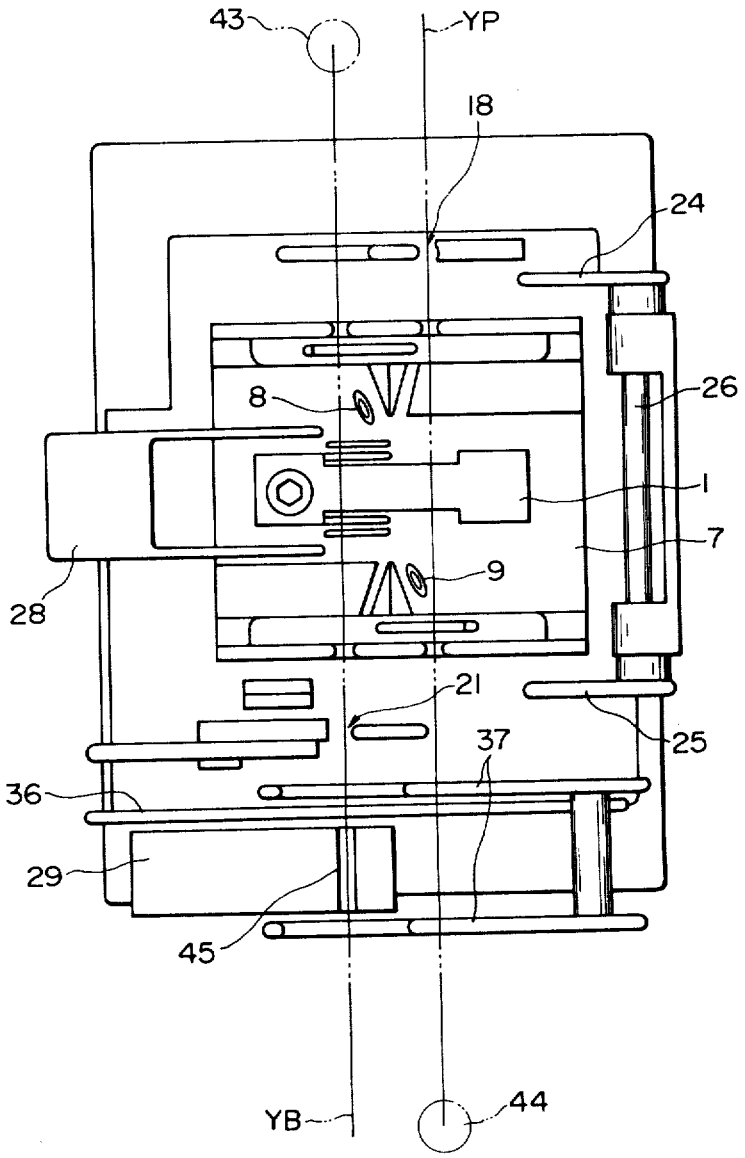
FIG. 1 is a front elevational view of a pneumatic yarn splicing device of the yarn end untwisting type.
Figure 5:
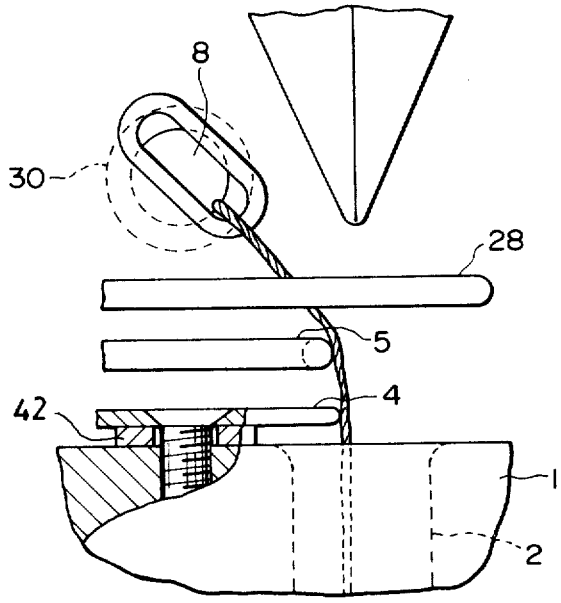
FIG. 5 is an enlarged side elevational view of a nozzle opening and surrounding parts.

FIG. 1 shows a pneumatic yarn splicing device of the yarn end untwisting type, which is employed in an automatic winder. Yarns to be spliced are guided by suction pipes 43, 44 to the pneumatic yarn splicing device. FIG. 5 illustrates a nozzle pipe having a constricted opening and surrounding parts. Designated at 1 is a yarn splicing member having a central cylindrical yarn splicing hole 2 into which a stream of compressed air from an air supply tube 34 through a block 41 is injected by an injection nozzle 3. A control plate 4 is screwed to the yarn splicing member 1 with a washer 42 interposed therebetween so as to cover half of each of the openings of the yarn splicing hole 2. Rods 5 project from a front plate 7 on both sides of the control plate 4. The front plate 7 has two nozzle openings 8, 9 defined therein, and also has yarn guides 10, 11, 12, 13. Yarn cutters 14, 15 are disposed one on each side of the front plate 7, and fork guides 16, 17 having yarn guide slots are positioned on both sides of the yarn cutters 14, 15, respectively.

Thread handlers 24, 25 are swingably disposed on both sides of the fork guides 16, 17, respectively, for angular movement about a support shaft 26. Designated at 27, 46 are stoppers. An upper clamp unit 18 serves to clamp a package yarn YP from a yarn package, and comprises a swing lever 19 and a spring-supported clamp plate 20. A lower clamp unit 21 serves to clamp a bobbin thread YB from a bobbin, and comprises a lever 22 and a movable clamp plate 23. Two nozzle pipes 30, 31 are slidably fitted in the block 41. A stream of compressed air from an air supply tube 35 is injected into the nozzle pipes 30, 31 through air conduits 33 and oblique injection holes 32 opening into the nozzle pipes 30, 31. As shown in FIG. 5, *each of the nozzle* openings 8, 9 in the front plate 7 is positioned to cover partly the end of each of the nozzle pipes 30, 31. Designated at 28 are yarn presser levers swingable on both sides of the yarn splicing member 1. Below the yarn splicing device, there is disposed a detector 29 mounted by a guide plate 36 and having a slit 45 into and out of which a yarn can be taken by a switch lever 37.

Operation of the yarn splicing device will now be described.

While a yarn is being wound by the automatic winder, the yarn runs through the slit 45 in the detector 29. When the yarn breaks, the detector 29 detects the breakage and issues an electric signal which actuates a cam behind the yarn splicing device to initiate a yarn splicing operation.

The suction pipe 44 picks up the package yarn YP and guides the same into the slit 45 in the detector 29. The package yarn YP picked up should be single in number, but there are instances in which two or more package yarns YP are supplied, and resulting spliced yarn ends become abnormal. The detector 29 checks the package yarn YP to prevent entry of two or more package yarns YP. When two or more package yarns are supplied, a cutter in the detector 29 is actuated to cut off the yarns and the subsequent yarn splicing operation will not be carried out.

Figure 2:
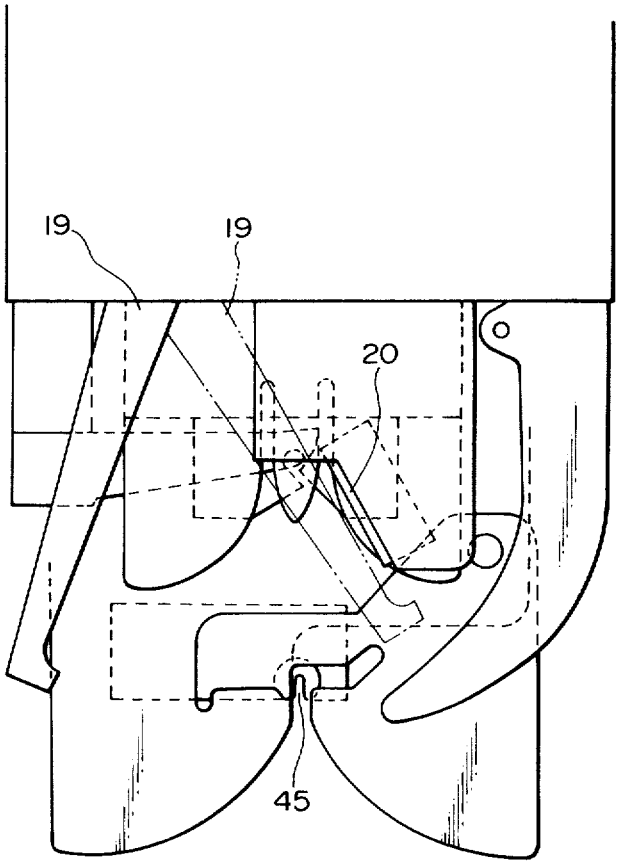
FIGS. 2 and 3 are plan views illustrative of operations of yarn presser levers, a swing lever, a switch lever, and yarn cutters.
Figure 3:
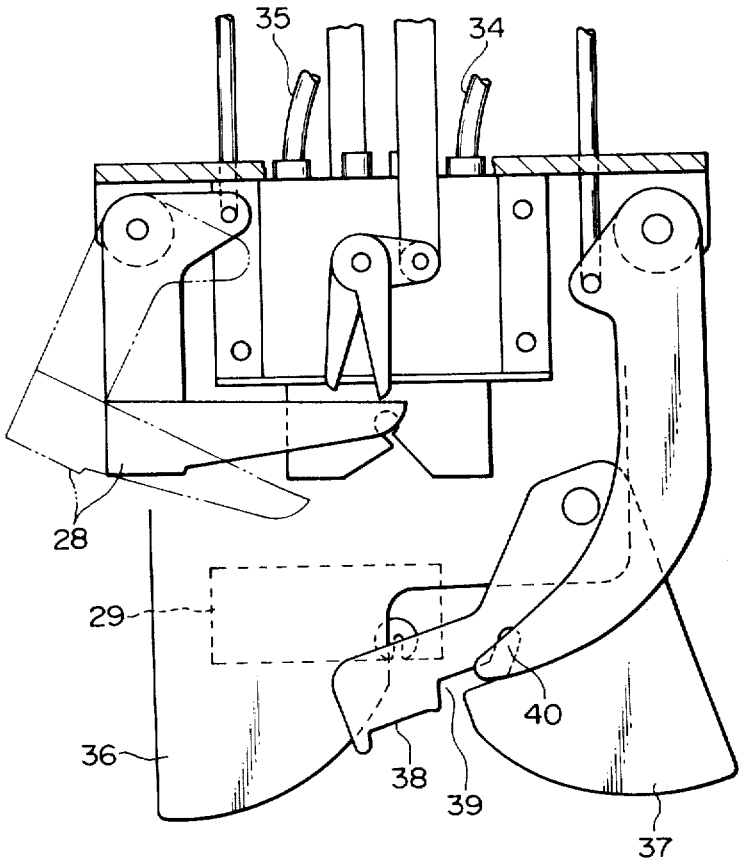
Figure 4:
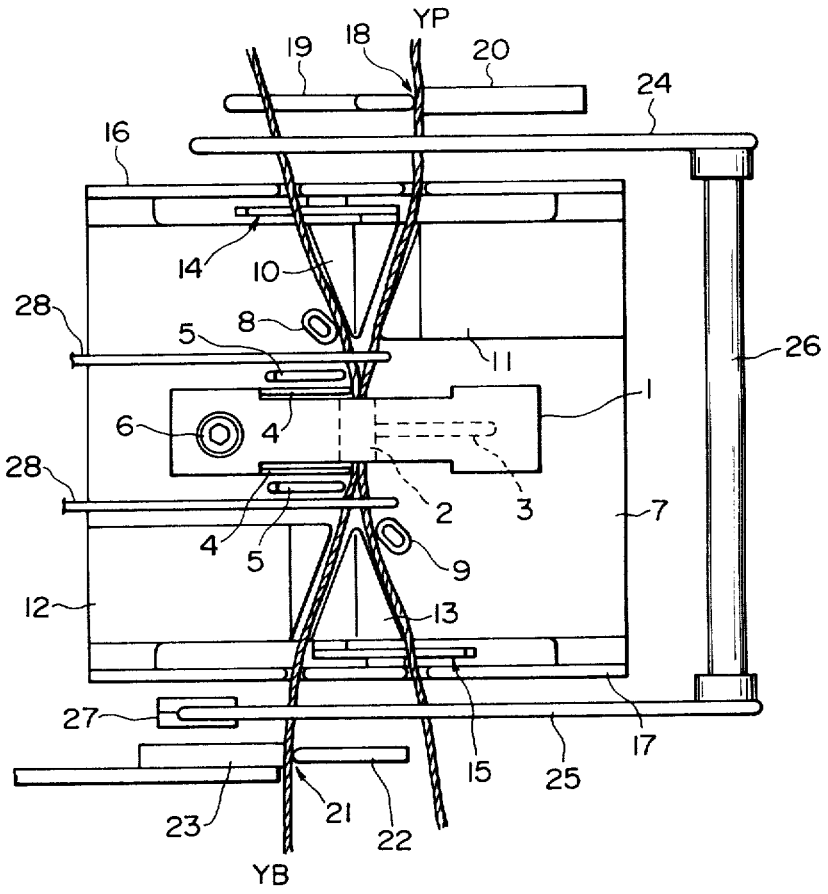
FIG. 4 is a front elevational view showing main parts of a yarn splicing device in which yarns are guided.
Figure 7:
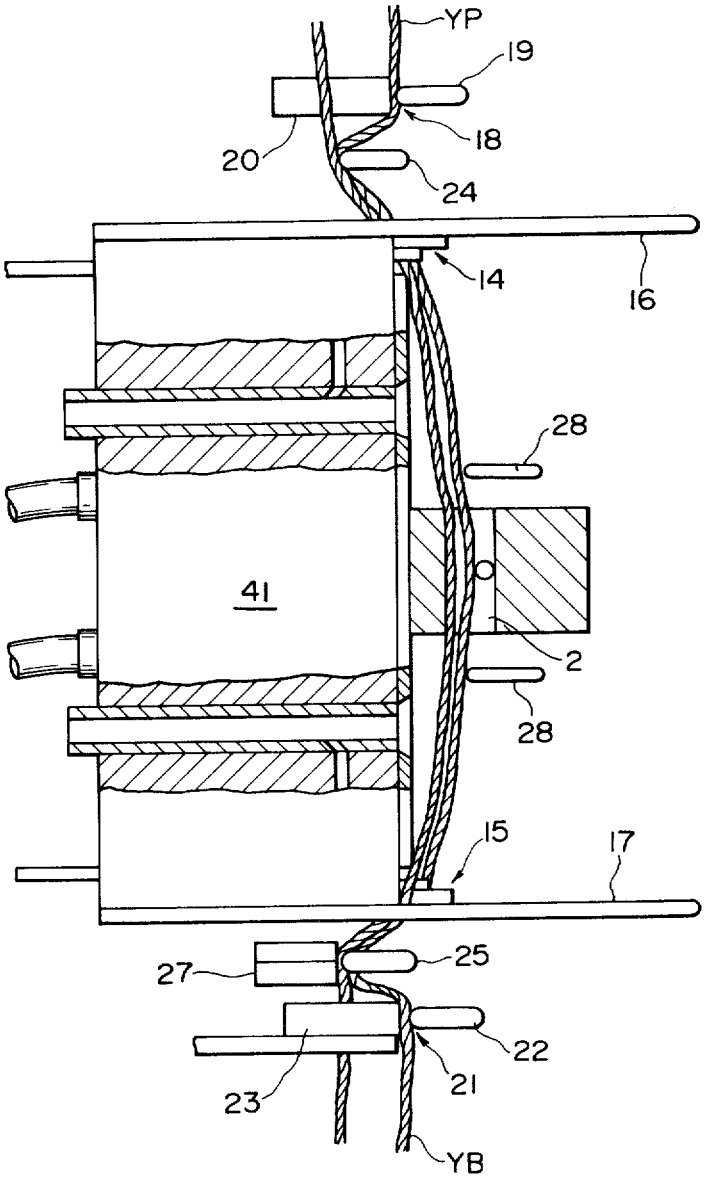
FIGS. 7, 8 and 9 are side elevational views showing successive steps of yarn splicing operation, FIG. 7 showing the yarns as guided, FIG. 8 showing yarn ends as untwisted, FIG. 9 showing yarn ends as pulled out.
Figure 8:
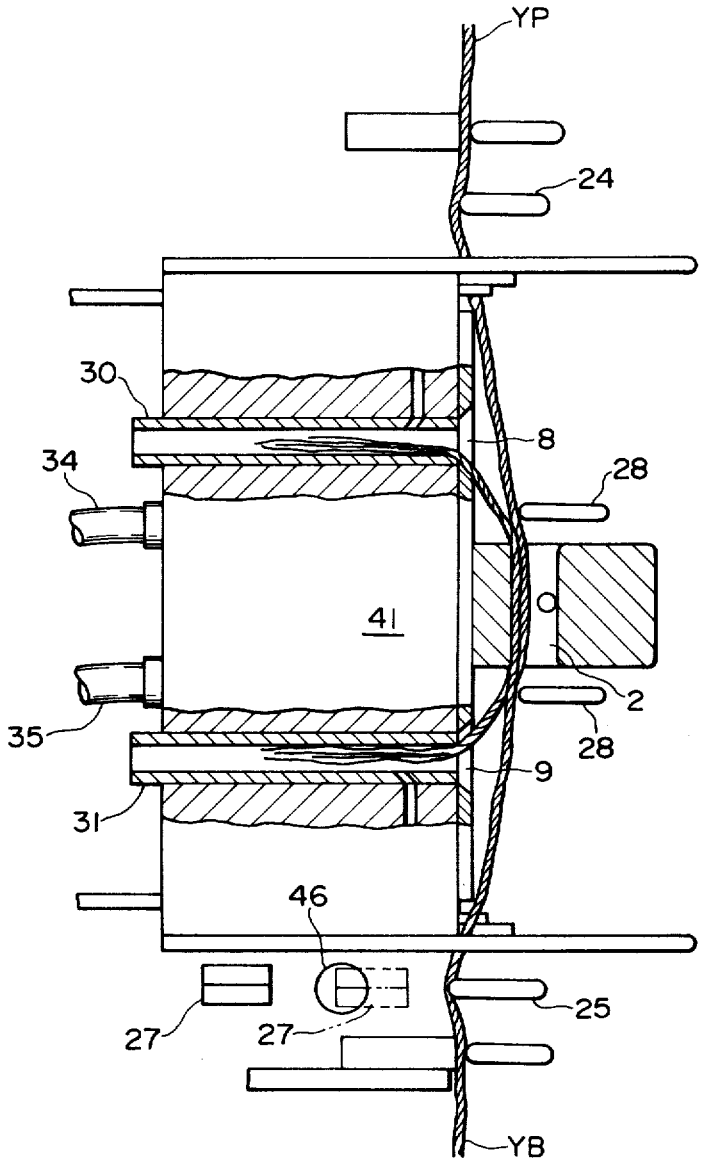
Figure 10:
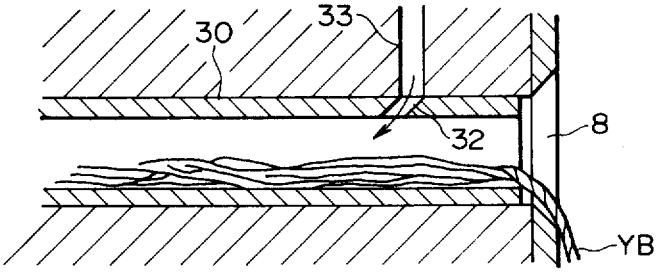
FIG. 10 is a cross-sectional view of a nozzle pipe in which a yarn ends is untwisted.

Then, the switch lever 37 swings from the position of FIG. 2 to the position of FIG. 3 in which the yarn YP is taken out of the slit 24 into an escape slot 40 through a guide slot 39. The swing lever 29 is angularly moved from the solid-line position to the two-dot-and-dash-line position of FIG. 2 for guiding the yarn YP between the swing lever 29 and the clamp plate 20. The suction pipe 43 then picks up the bobbin yarn YB, brings the yarn YB into abutment against a hook 28 of the switch lever 39, and guides the yarn YP leftward of the swing lever 19. The positions of the yarns YP, YB at this time are illustrated by the two-dot-and-dash lines in FIG. 1. The thread handlers 24, 25 turn to the positions in which they abut against the stopper 27 to guide the yarns YP, YB. The yarn presser lever 28 is also moved from the two-dot-and-dash-line position to the solid-line position of FIG. 3 to guide the yarns YP, YB reliably into the yarn splicing hole 2. The position of the parts at this time is illustrated in FIG. 4. The yarn YP passes through the clamp unit 18, a groove in the fork guide 16, the yarn splicing hole 2, the yarn cutter 15 and thence through a groove in the fork guide 17. The yarn YB passes through the clamp unit 21, a groove in the fork guide 17, the yarn splicing hole 2, the yarn cutter 14 and thence through a groove in the fork guide 16. The clamp units 18, 21 move from the positions of FIG. 4 to clamp the yarns YP, YB as shown in the side elevational view of FIG. 7. Thereafter, the yarn cutters 14, 15 are actuated and substantially at the same time the compressed air is injected through the injection holes 32 into the nozzle pipes 30, 31. Since the injection holes 32 extend obliquely with respect to the nozzle pipes 30, 31 to direct the injected compressed air in the direction of the arrow shown in FIG. 10, air is drawn in through the nozzle openings 8, 9 to suck and attract cut yarn ends into the nozzle pipes with the suction air streams. The thread handlers 24, 25 which have been held against the stopper 27 are retracted to insert the yarn ends deeply into the nozzle pipes, as shown in FIG. 8. The stopper 27 is retracted from the two-dot-and-dash-line position to the solid-line position of FIG. 8. The manner in which the yarn ends are drawn in is shown in FIGS. 5 and 10. The yarn ends are untwisted and neatly arranged by a swirling flow of air created in the pipes.

Figure 6:
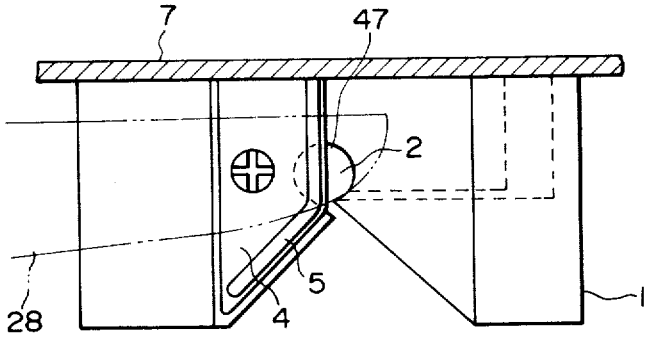
FIG. 6 is a plan view of a yarn splicing member.
Figure 9:
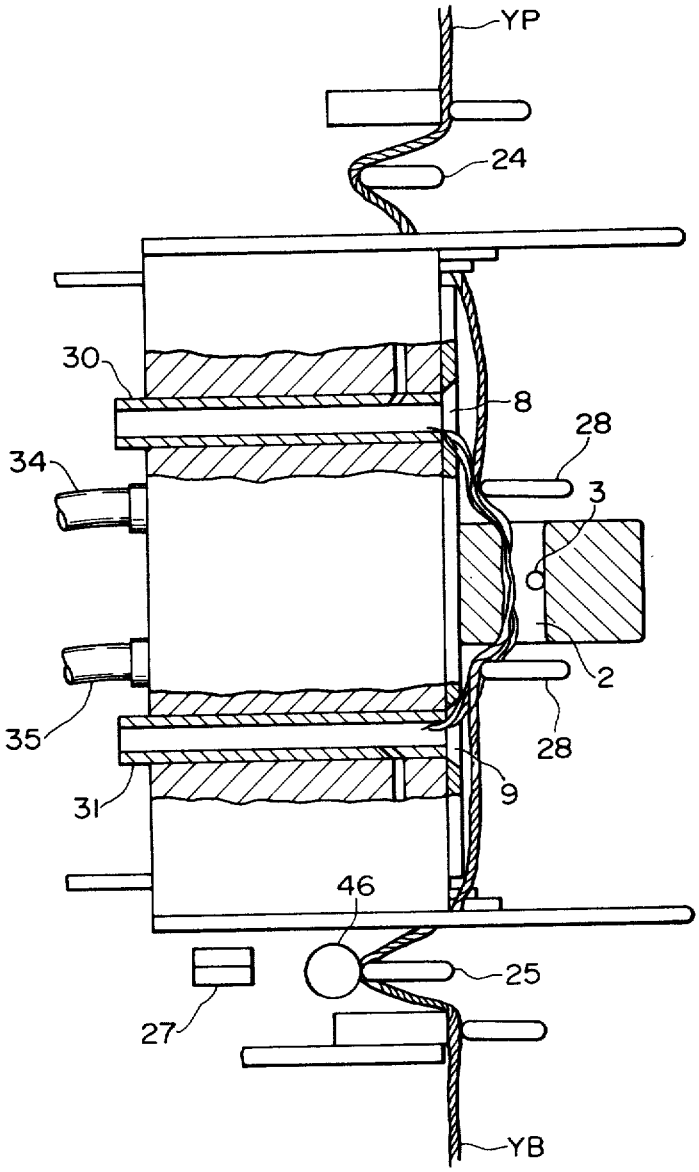
Figure 11:
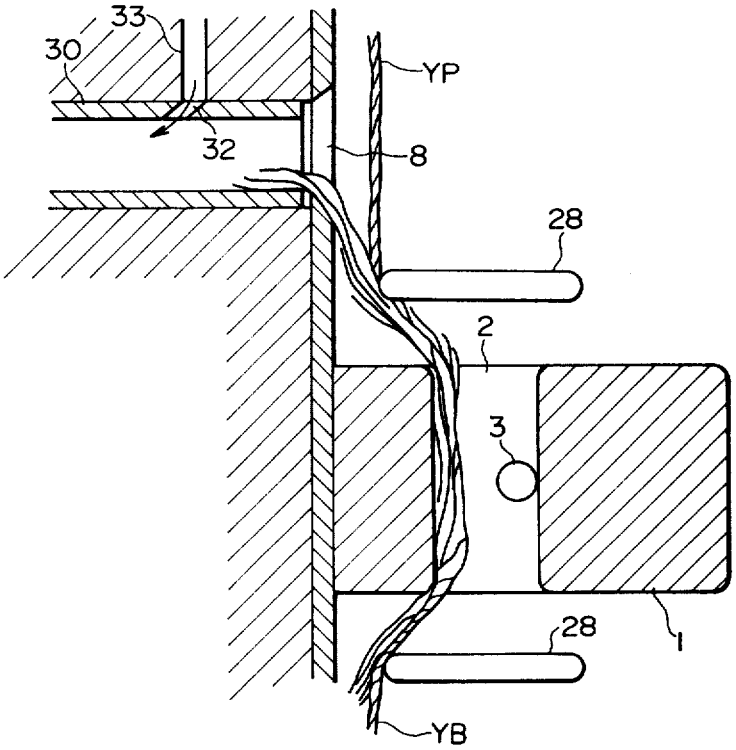
FIGS. 11 and 12 are cross-sectional views of the nozzle pipe from which the yarn end is drawn out.

Subsequently, the thread handlers 24, 25 are advanced again into abutment against a stopper 46. As shown in FIG. 9, the yarn ends are pulled out with their tips slightly left in the nozzle pipes. The yarn presser levers 28 are also advanced. While the yarn distal ends are being attracted and tensioned by the suction air streams at the nozzle pipe openings, the yarns YP, YB are arranged in parallel at a yarn splicing position 47, as shown in FIG. 6, deep within the yarn splicing hole 2. The par position at this time is illustrated in FIGS. 9 and 11. Thereafter, compressed air is injected through the nozzle 3 into the yarn splicing hole 2. The paralleled yarn ends become twined, and the yarn distal ends which have undergone the suction air streams are blended into the spliced ends under the action of the compressed air streams and rotation of the yarns about their own axes, thus producing sightly spliced yarn ends. When the yarn splicing operation is completed, the yarns are released from the clamp units 18, 21, the thread handlers 24, 25 are withdrawn, whereupon the yarn begins to run, coming out of the yarn splicing hole 2. The switch lever 37 is returned from the position of FIG. 3 to the position of FIG. 2, and the yarn which has been held against the hook 38 enters the slit 45. Two or more bobbin yarns YB are checked at this time.

Figure 12:
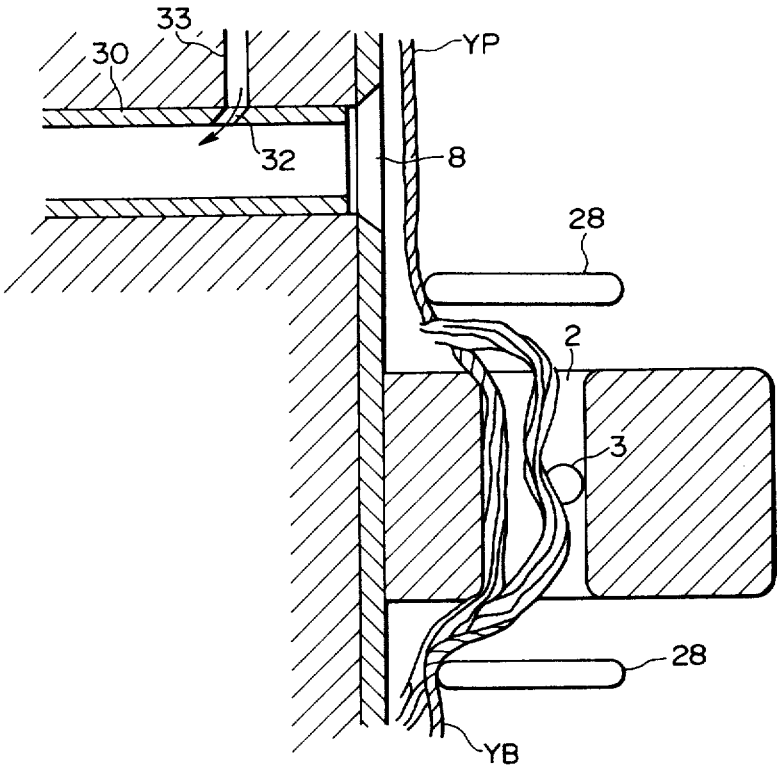

The series of yarn splicing operations as effected by the yarn splicing device according to the illustrated embodiment has been described. When the yarn ends are drawn out from the position of FIG. 10 to the position of FIG. 11, the speed of flow of the suction air streams at the nozzle openings is increased to draw in the yarn ends with a large force, thus preventing the resilient core spun yarns from being abruptly pulled out under their own resiliency, a condition which would be the case with simply opening nozzle pipes which would allow the core spun yarns to be drawn out rapidly and could not be spliced into a neatly joined yarn, as shown in FIG. 12.

The nozzle openings which reduce the opening areas of the nozzle pipes may be of other shapes than that according to the illustrated embodiment. However, it should be taken into account that the yarn untwisting action is affected by the position in which the yarns are located within the nozzle pipes.

Figure 13:
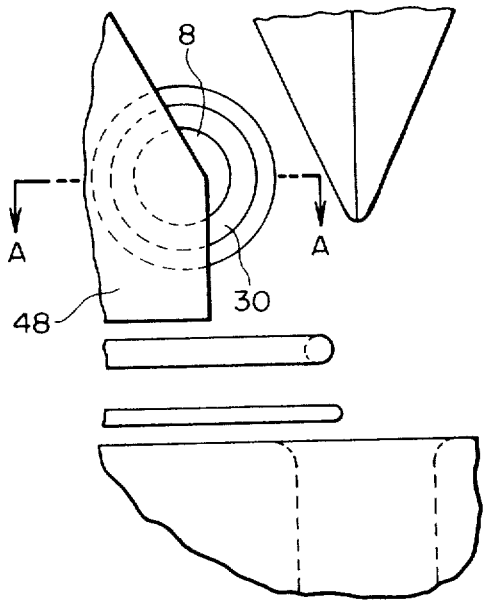
FIG. 13 is a side elevational view of another embodiment.
Figure 14:
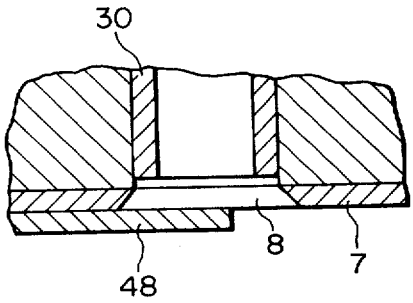
FIG. 14 is a cross-sectional view taken along line A—A of FIG. 13.

FIG. 13 and FIG. 14, which is a cross-sectional view taken along line A—A, are illustrative of an embodiment in which a cover plate 48 is mounted on the front plate 7 and serves to reduce the opening area of the nozzle pipe.

What is claimed is:

1. A pneumatic yarn splicing device of the yarn end untwisting type including two nozzle pipes for untwisting and sucking yarn ends, and a yarn splicing hole disposed midway between the nozzle pipes for splicing the untwisted yarn ends with a stream of air, characterized in that said nozzle pipes have opening areas reduced with respect to the diameter of the nozzle pipe for increasing the sucking and attractive force by the nozzle pipes.

2. A pneumatic yarn splicing device as claimed in claim 1, wherein nozzle openings are formed on a front plate covering a block in which two nozzle pipes, a compressed air supply tube for the nozzle pipes and a compressed air supply tube for the yarn splicing hole are provided, and on which a yarn splicing member having the yarn splicing hole is mounted, and each of the nozzle openings is so positioned as to cover partly the end of each of the nozzle pipes.

3. A pneumatic yarn splicing device as claimed in claim 1, wherein the nozzle pipes are opened on a front plate covering a block in which two nozzle pipes, a compressed air supply tube for the nozzle pipes and a compressed air supply tube for the yarn splicing hole are provided, and on which a yarn splicing member having the yarn splicing hole is mounted and cover plates are further mounted on the front plate to cover partly the openings of the nozzle pipe and to reduce the opening area of the nozzle pipes respectively.

4. A pneumatic yarn splicing device as claimed in claim 2 or 3, wherein said two nozzle pipes are slidably fitted in the block and a stream of compressed air from the air supply tube is injected into the nozzle pipes from oblique injection holes being opened into the nozzle pipes.

* * * * *